8-107 SR
FIP8309 XR 4,243,391

United States Patent [19]
Puchta et al.

[11] 4,243,391
[45] Jan. 6, 1981

[54] PROCESS FOR BLEACHING TEXTILES IN THE MECHANICAL LAUNDRY DRIER

[75] Inventors: Rolf Puchta, Haan; Karl Schwadtke, Leverkusen; Hans Harder; Rudolf Weber, both of Düsseldorf, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 945,439

[22] Filed: Sep. 25, 1978

[30] Foreign Application Priority Data

Oct. 3, 1977 [DE] Fed. Rep. of Germany ..... 2744457

[51] Int. Cl.[3] ..... D06L 3/02; D06L 3/14; D06L 3/16

[52] U.S. Cl. ..... 8/111; 8/101; 8/107; 8/137

[58] Field of Search ..... 8/101, 107, 111, 137

[56] References Cited

U.S. PATENT DOCUMENTS

| | | | |
|---|---|---|---|
| 2,173,474 | 9/1939 | Evoy | 8/111 |
| 2,194,358 | 3/1940 | Hundt et al. | 8/111 |
| 2,489,278 | 11/1949 | Fink | 8/137 |
| 2,777,749 | 1/1957 | Young | 8/111 |
| 2,858,183 | 10/1958 | Potter | 8/111 |
| 2,859,087 | 11/1958 | Hawkinson et al. | 8/111 |
| 2,927,840 | 3/1960 | Dithmar et al. | 8/111 |
| 2,983,568 | 5/1961 | Nerney et al. | 8/111 |
| 3,525,695 | 8/1970 | Mouret et al. | 8/101 |
| 4,016,090 | 4/1977 | Nakagawa et al. | 8/111 |
| 4,017,411 | 4/1977 | Diehl et al. | 8/111 |

OTHER PUBLICATIONS

Shanley, E. S. et al., The Hydrogen Peroxide Dry-In Process for Bleaching Wool, Amer. Dyestuff Reporter, vol. VO, No. 1, pp. 1-4, Jan. 8, 1951.

*Primary Examiner*—Ronald W. Griffin
*Attorney, Agent, or Firm*—Hammond & Littell, Weissenberger & Muserlian

[57] ABSTRACT

The invention relates to a process for bleaching washed textiles in the tumbler of a mechanical laundry drier with an aqueous solution of hydrogen peroxide in an amount such that the residual moisture adhering to the textile material before drying contains 0.05 to 1 gm/liter of hydrogen peroxide, the drying being conducted so that the moist textile material assumes a temperature of at least 50° C., preferably 55° C. to 80° C., for a period of at least 10 to 60 minutes. An addition of quaternary ammonium salts improves the bleach result and the softness of the textile material. An addition of a powdered bleaching activator of the N-acyl type also improves the bleach results.

13 Claims, No Drawings

PROCESS FOR BLEACHING TEXTILES IN THE MECHANICAL LAUNDRY DRIER

BACKGROUND OF THE INVENTION

A number of methods are known whereby moist textiles are bleached during the drying in heated mechanical laundry dryers. It has, for example, been proposed to apply on the moist laundry a particulate bleaching agent, which consists of a per-oxygen compound, in particular perborate, and which optionally is present in mixture with an activator, such as tetraacetylglycoluril. An essential disadvantage of this process is that the perborate and/or the activator do not spread evenly on the moist fabric, for one thing, because of their relatively low water solubility, so that a uniform bleaching effect is not obtained. Besides, the borate crystals remain on the fabric after the bleaching process, which may be disturbing in use. In another known method, the solid bleaching agent is disposed in a porous container or an open-cell sponge, through the openings of which the bleaching agent is allowed to pass and to act on the textiles to be bleached. Also, with such an arrangement, it may happen that only individual textile portions come in contact with the bleaching agent, in particular, when the container or sponge gets temporarily caught in one of the textile pieces. As the drying process progresses, moreover, the passage from the bleach vehicle to the textile material is made difficult, since because of the lacking water, the perborate crystals no longer dissolve and in solid form do not react with the substrate. Textile portions which come in contact with the bleach vehicle relatively late are, therefore, not bleached or only partially or deficiently so.

OBJECTS OF THE INVENTION

An object of the present invention is to develop a process for bleaching textiles in a mechanical laundry drier by the addition of aqueous hydrogen peroxide thereto before drying whereby the deficiencies of the prior art are overcome and efficient and even bleaching are obtained.

Another object of the present invention is to develop a process for bleaching textiles in a mechanical laundry drier consisting of the steps of adding a sufficient amount of an aqueous hydrogen peroxide solution to previously washed textiles before heating the same, so that the residual moisture adhering to the textiles contains from 0.05 to 1 gm/liter of hydrogen peroxide, heating said damp textiles under mechanical agitation and hot-air flow in such a manner that the temperature of said damp textiles is at least 50° C. for a period of at least 5 minutes, and recovering dried, bleached textiles.

These and other objects of the invention will become more apparent as the description thereof proceeds.

DESCRIPTION OF THE INVENTION

The subject of the invention is a process for bleaching textiles in a mechanical laundry dryer, characterized in that, before, or at the start of, the drying cycle, the previously washed textiles are treated with an aqueous solution of hydrogen peroxide, so that the residual moisture of the textile material contains 0.05 to 1 gm/liter of hydrogen peroxide, whereupon the drying is conducted so that the moist textile material assumes a temperature of at least 50° C. for a period of at least 5 minutes.

More particularly, the present invention relates to a process for bleaching textiles in a mechanical laundry drier consisting of the steps of adding a sufficient amount of an aqueous hydrogen peroxide solution to previously washed textiles before heating the same, so that the residual moisture adhering to the textiles contains from 0.05 to 1 gm/liter of hydrogen peroxide, heating said damp textiles under mechanical agitation and hot-air flow in such a manner that the temperature of said damp textiles is at least 50° C. for a period of at least 5 minutes, and recovering dried, bleached textiles.

Preferably, the temperature of the damp laundry should be 55° C. to 80° C. during a period of 10 to 60 minutes. Raising the laundry temperature is optionally possible to as much as 90° C. or 95° C., depending on the type of textile material and the capacity of the dryer.

The aqueous hydrogen peroxide treatment solution may, depending on the type of addition, have a hydrogen peroxide content of, for example, 0.05 to 10 gm/liter, preferably, 0.1 to 6 gm/liter. It may, moreover, contain other additives, which effect the feel or ease of ironing or other property of the laundry or which increase the bleaching effect of the hydrogen peroxide.

The additives which effect the physical properties of the laundry include primarily softening agents of the class of the salts of quaternary ammonium compounds dispersible in water, the quaternary compound containing at least one aliphatic hydrocarbon radical with 12 to 20 carbon atoms, such as an alkyl or an alkenyl group. Suitable compounds are, for example, those of the formulas

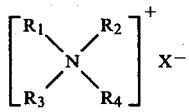

(I)

and

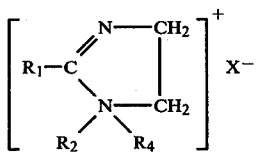

(II)

wherein $R_1$ is an aliphatic hydrocarbon radical having from 12 to 20 carbon atoms selected from the group consisting of alkyl and alkenyl, $R_2$ is a group selected from the group consisting of $R_1$ and alkyl having from 1 to 4 carbon atoms, $R_3$ is a group selected from the group consisting of alkyl having from 1 to 4 carbon atoms, phenyl, benzyl and cyclohexyl, $R_4$ is a group selected from the group consisting of alkyl having from 1 to 4 carbon atoms and $-(CH_2-CH_2-O)_nH$, where n is an integer from 1 to 3, and X represents the anion of an acid selected from the group consisting of mineral acids, carboxylic acids, sulfonic acids and sulfato acids. The anion may be, for example, chloride, bromide, sulfate, acetate, lactate, citrate or methosulfate. Preferably, compounds of formula (I) are used in which $R_1$ and $R_2$ represent linear alkyl radicals with 12 to 18 carbon atoms, in particular, tallow fatty alkyl radicals, $R_1$ and $R_2$ being alkyl radicals with 1 to 2 carbon atoms.

The content of the aforesaid quaternary salts in the residual moisture adhering aqueous bleaching solutions is 0.05 to 2 gm/liter, depending on the type of use. It was surprising to see that an addition in such quantity not only improved the feel or handle of the textile material, but that also the bleaching effect of the hydrogen peroxide was increased. This finding is the more astonishing as the quaternary ammonium salts contain no reactive groups which could interact with the per-oxygen.

If necessary, a further increase of the bleaching effect can be achieved by an additional use of known bleaching activators from the class of the N-acyl compounds, their quantity being taken so that there are from 0.1 to 2 equivalents of N-acyl groups per mol of $H_2O_2$. The preferred compounds of this class include tetraacetyl-glycoluril and tetraacetyl-ethylenediamine. The bleaching activator is preferably scattered or dusted in pulverized form on the moist textiles to be treated. With this procedure, namely, application of the oxygen bleaching agent in dissolved form and of the activator in pulverized form, an especially good bleaching result is achieved. If, however, the activator is applied in the form of an aqueous solution, generally no increase of the bleaching effect is observable. In the interest of a uniform distribution and bleaching effect, the activator should have a grain size of less than 0.4 mm, preferably less than 0.2 mm.

Applying the treatment solution or the pulverized activator on the textile material can be done before placing it in the dryer, for example, by spraying the washed and spun laundry with the solution or respectively the separately kept solutions. When spraying the "spin-dry" textile material, its residual moisture must be taken into consideration, for which reason one uses advantageously solutions having a content of at least 1%, preferably 2%, to 6 wt.% of $H_2O_2$. The spraying with the aqueous solution can also be effected inside the dryer through a nozzle provided therein, which is connected via a proportioning pump with a storage tank or a charging device. For this procedure, it is advisable to carry out the spraying at the beginning of the drying cycle, that is, before the dryer has reached higher temperatures. If desired, the spraying may take place several times.

Lastly, it is possible also to apply the solutions, possibly including the activator, in the last rinse cycle following a regular wash cycle. It must then be accepted, however, that due to the centrifuging of the rinse solution a considerable portion of the bleaching agent or of the activator will be removed and is thus lost. This procedure must therefore be regarded as less preferred. The treatment solution to be used in this case, which is expediently prepared just before use, may contain, for example, 0.1 to 0.5 gm/liter of hydrogen peroxide, 0.1 to 0.3 gm/liter of the softening quaternary salt according to formula (I), and possibly 0.1 to 1 gm/liter of tetraacetyl-glycoluril or tetraacetyl-ethylenediamine.

The following examples are illustrative of the practice of the invention without being limitative in any respect.

EXAMPLE 1

Cotton strips (dimensions 10×10 cm), soiled with red wine, blueberry juice, and tea, which had been sewn on to carrier fabrics of cotton (dimension 50×50 cm), were used as test fabrics. The textile material (dry weight 3.2 kg) was washed in an automatic drum washing machine with a commercial brand detergent at 60° C., rinsed, and spun dried. Then the textiles were saturated with aqueous solutions having the compositions shown in the following Table 1. After the excess moisture had been spun off, the laundry pieces were transferred to a drum dryer and dried during the course of 60 minutes at a temperature of 55° C. to 80° C. The whiteness (barium sulfate standard = 100%) of the samples was determined photometrically and the mean value of 5 determinations was taken. The results are compiled in Table 1. They show that the quaternary salt alone does not cause any brightening (test A). Use of hydrogen peroxide leads to intensive brightening of the samples (Test B), which is further intensified in the presence of quaternary salt (Test C). The additional use of a bleaching activator in solution brings no additional increase, occasionally even a decrease of the bleaching effect. The tests B and, in particular, C, represent the procedure according to the invention.

TABLE 1

| Test | | % Whiteness | | |
|---|---|---|---|---|
| | | Red wine | Blueberry | Tea |
| — | Starting value | 32.1 | 32.2 | 32.5 |
| — | After washing treatment | 59.0 | 82.1 | 63.2 |
| A | 0.14 gm/l quaternary salt | 59.0 | 82.1 | 63.2 |
| B | 0.2 gm/l $H_2O_2$ | 69.1 | 86.5 | 72.2 |
| C | 0.2 gm/l $H_2O_2$<br>0.14 gm/l quaternary salt | 69.4 | 87.2 | 72.5 |
| D | 0.2 gm/l $H_2O_2$<br>0.14 gm/l quaternary salt<br>+ 0.1 gm/l TAGU | 66.9 | 87.0 | 71.3 |

The quaternary salt employed was dimethyl-ditallow-fatty-alkyl-ammonium chloride, and TAGU represents tetraacetyl-glycoluril.

EXAMPLE 2

Textile samples which had been washed, saturated with the treatment solution given in Table 2 below, and then spun dried according to the procedure of Example 1, were (E) sprayed with a 3% (by wt.) aqueous solution of TAGU at a rate equivalent to 0.2 gm/TAGU per 100 $cm^2$ of test fabric;

(F) dusted with fine TAGU powder (grain size <0.2 mm) (at a rate of 0.2 gm TAGU per 100 $cm^2$ textile fabric); and then dried in the dryer as described in Example 1.

The results of the whiteness measurements, which are compiled in Table 2, show that only in the case of the treatment with bleaching activator powder (Test F according to invention) a definite increase of the whiteness occurred, while it largely did not occur in the case of the comparison test E.

TABLE 2

| Test | | % Whiteness | | |
|---|---|---|---|---|
| | | Red Wine | Blueberry | Tea |
| C | 0.2 gm/l $H_2O_2$<br>0.14 gm/l quaternary salt | 69.4 | 87.2 | 72.5 |
| E | 0.2 gm/l $H_2O_2$<br>0.14 gm/l quaternary salt<br>TAGU solution sprayed on | 69.1 | 86.6 | 72.9 |
| F | 0.2 gm/l $H_2O_2$<br>0.14 gm/l quaternary salt<br>TAGU powder dusted on | 71.2 | 87.7 | 76.0 |

EXAMPLE 3

Textile samples washed as stated in Example 1 and then spun dried were sprayed with a 6% (by wt.) aqueous solution of $H_2O_2$, so that the total residual moisture adhering to the textile material showed a concentration of 0.4 gm/liter of $H_2O_2$. In addition, as described in Example 2, the samples were dusted with TAGU powder, at a rate of 0.5 gm per 100 $cm^2$ textile fabric. The subsequent drying occurred as stated in Example 1. The results can be seen from Table 3.

TABLE 3

| Test | | % Whiteness | | |
|---|---|---|---|---|
| | | Red Wine | Blueberry | Tea |
| — | Starting value | 32.1 | 32.2 | 32.5 |
| — | After wash treatment | 59.0 | 82.1 | 63.2 |
| G | 0.4 gm/l $H_2O_2$ TAGU powder dusted on | 79.3 | 88.1 | 80.5 |

This Example shows the preferred embodiment of the invention where the desired amount of hydrogen peroxide is added to the damp laundry by the spraying thereon of a more concentrated aqueous hydrogen peroxide solution.

The preceding specific embodiments are illustrative of the practice of the invention. It is to be understood however, that other expedients known to those skilled in the art or disclosed herein, may be employed without departing from the spirit of the invention or the scope of the appended claims.

We claim:

1. A process for bleaching textiles in a mechanical laundry drier consisting of the steps of adding a sufficient amount of an aqueous hydrogen peroxide solution and an aqueous solution of a textile softening quaternary ammonium salt dispersible in water to previously washed textiles before heating the same, so that the residual moisture adhering to the textiles contains from 0.05 to 1 gm/liter of hydrogen peroxide and from 0.05 to 2 gm/liter of said textile softening ammonium salt, heating said damp textiles under mechanical agitation and hot air flow in such a manner that the temperature of said damp textiles is from 55° C. to 80° C. for a period of at least 5 minutes, and recovering dried, bleached textiles.

2. The process of claim 1 wherein the residual moisture adhering to the textiles contains from 0.1 to 0.5 gm/liter of hydrogen peroxide.

3. The process of claim 1 wherein the temperature of said damp textiles is at least 55° C. for a period of from 10 to 60 minutes.

4. The process of claim 1 or 3 wherein a sufficient amount of an N-acyl bleach activator is added to said previously washed textiles before heating the same so that from 0.1 to 2 mols of N-acyl groups are present per mol of hydrogen peroxide.

5. The process of claim 4 wherein said N-acyl bleach activator is selected from the group consisting of tetraacetyl-ethylenediamine and tetraacetyl-glycoluril.

6. The process of claim 4 wherein said N-acyl bleach activator is in the form of a fine powder and is added to said previously washed textiles by dusting thereon.

7. The process of claim 1 wherein said previously washed textiles are introduced into said heating zone under mechanical agitation and hot air flow before said step of adding said aqueous hydrogen peroxide solution and said textile softening ammonium salt to previously washed textiles.

8. The process of claim 1 wherein said step of adding said aqueous hydrogen peroxide solution and aqueous solution of said textile-softening quaternary ammonium salt to the previously washed textiles is completed before introduction of said damp textiles into said heating zone under mechanical agitation and hot air flow.

9. The process of claim 1 wherein the residual moisture adhering to the textiles contains from 0.1 to 0.5 gm/liter of hydrogen peroxide and from 0.1 to 0.3 gm/liter of textile-softening quaternary ammonium salt.

10. The process of claim 1 wherein said textile softening quaternary ammonium salt has a formula selected from the group consisting of

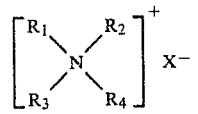

and

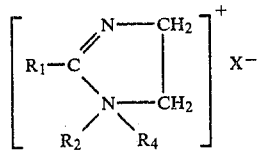

wherein $R_1$ is an aliphatic hydrocarbon radical having from 12 to 20 carbon atoms selected from the group consisting of alkyl and alkenyl, $R_2$ is a group selected from the group consisting of $R_1$ and alkyl having from 1 to 4 carbon atoms, $R_3$ is a group selected from the group consisting of alkyl having from 1 to 4 carbon atoms, phenyl, benzyl and cyclohexyl, $R_4$ is a group selected from the group consisting of alkyl having from 1 to 4 carbon atoms and $-(CH_2-CH_2-O)_nH$, where n is an integer from 1 to 3, and X represents the anion of an acid selected from the group consisting of mineral acids, carboxylic acids, sulfonic acids and sulfato acids.

11. A process for bleaching textiles in a mechanical laundry drier consisting of the steps of adding a sufficient amount of an aqueous hydrogen peroxide solution to previously washed textiles before heating the same, so that the residual moisture adhering to the textiles contains from 0.05 to 1 gm/liter of hydrogen peroxide, and adding a sufficient amount of an N-acyl bleach activator selected from the group consisting of tetraacetyl-ethylenediamine and tetraacetyl-glycoluril, in the form of a fine powder to said previously washed textiles by dusting thereon, so that from 0.1 to 2 mols of N-acyl groups are present per mol of hydrogen peroxide, heating said damp textiles under mechanical agitation and hot air flow in such a manner that the temperature of said damp textiles is from 55° C. to 80° C. for a period of at least 5 minutes, and recovering dried, bleached textiles.

12. The process of claim 11 wherein the residual moisture adhering to the textiles contains from 0.1 to 0.5 gm/liter of hydrogen peroxide.

13. The process of claim 11 wherein said step of adding said aqueous hydrogen peroxide solution and said fine powder bleach activator to the previously washed textiles is completed before introduction of said damp textiles into said heating zone under mechanical agitation and hot air flow.

* * * * *